US009754530B2

(12) United States Patent
Shin

(10) Patent No.: US 9,754,530 B2
(45) Date of Patent: Sep. 5, 2017

(54) DISPLAY DEVICE HAVING REDUCED POWER CONSUMPTION

(71) Applicant: Samsung Display Co., Ltd., Yongin, Gyeonggi-Do (KR)

(72) Inventor: Hyung-Min Shin, Yongin (KR)

(73) Assignee: SAMSUNG DISPLAY CO., LTD. (KR)

( * ) Notice: Subject to any disclaimer, the term of this patent is extended or adjusted under 35 U.S.C. 154(b) by 57 days.

(21) Appl. No.: 14/735,032

(22) Filed: Jun. 9, 2015

(65) Prior Publication Data

US 2016/0125799 A1 May 5, 2016

(30) Foreign Application Priority Data

Oct. 31, 2014 (KR) ..... 10-2014-0150321

(51) Int. Cl.
*G09G 3/3208* (2016.01)

(52) U.S. Cl.
CPC ... *G09G 3/3208* (2013.01); *G09G 2320/0257* (2013.01); *G09G 2320/068* (2013.01); *G09G 2330/021* (2013.01); *G09G 2330/028* (2013.01)

(58) Field of Classification Search
None
See application file for complete search history.

(56) References Cited

U.S. PATENT DOCUMENTS 7,036,025 B2 * 4/2006 Hunter ..... G09G 3/342 700/12
7,091,471 B2 * 8/2006 Wenstrand ..... G06F 1/3203 250/221
2002/0149575 A1 10/2002 Moon
2007/0070092 A1 3/2007 Oh et al.
2008/0225039 A1 9/2008 Oshita et al.
2011/0025677 A1 2/2011 Park et al.
2011/0206353 A1 * 8/2011 Yeo ..... G06F 1/3231 386/291
2012/0044231 A1 * 2/2012 Park ..... G06F 1/263 345/211
2012/0249541 A1 * 10/2012 Sato ..... G06F 1/1694 345/419
2013/0106681 A1 * 5/2013 Eskilsson ..... G06F 3/013 345/156
2013/0257710 A1 * 10/2013 Oh ..... G06F 1/3231 345/156

FOREIGN PATENT DOCUMENTS

KR 10-2002-0067813 A 8/2002
KR 10-2006-0018096 A 2/2006
KR 10-2007-0006334 A 1/2007
KR 10-2007-0035844 A 4/2007
KR 10-2011-0013689 A 2/2011

* cited by examiner

*Primary Examiner* — David D Davis
(74) *Attorney, Agent, or Firm* — Innovation Counsel LLP

(57) ABSTRACT

A display device includes a display panel, a power supply, and a driving circuit. The display panel includes a plurality of pixels. The power supply is configured to supply a first power voltage and a second power voltage to the display panel. The driving circuit is configured to determine, based on a viewing angle information signal, whether to operate the display device in a general mode or a low power mode. If the display device is operated in the low power mode, the driving circuit is further configured to deactivate the power supply, and supply a first subsidiary power voltage and a second subsidiary power voltage to the display panel.

18 Claims, 3 Drawing Sheets

DISPLAY DEVICE HAVING REDUCED POWER CONSUMPTION

CROSS-REFERENCE TO RELATED APPLICATION

This application claims priority to and the benefit of Korean Patent Application No. 10-2014-0150321 filed Oct. 31, 2014 in the Korean Intellectual Property Office, the entire contents of which are incorporated herein by reference in their entirety.

BACKGROUND

Technical Field

The present disclosure generally relates to a display device, and more particularly, to a display device having reduced power consumption.

Description of Related Art

Presently, various types of display devices have been developed to replace cathode ray tubes which have the disadvantage of being heavy and bulky. The various types of display devices that have been developed include liquid crystal displays, field emission displays, plasma display panels, organic light emitting displays, etc.

The abovementioned display devices display images using different mechanisms. For example, organic light emitting displays display images using organic light emitting diodes (OLEDs) in which light is generated by the recombination of electrons and holes. Organic light emitting displays possess advantages such as good color reproducibility, thin form factor, fast response speed, and low power consumption. As a result, organic light emitting displays are often used in the display device of portable terminals such as cell phones, smart watches, and tablet personal computers (PCs), etc.

The power consumption in portable terminals can be reduced using various methods. For example, if a new command is not input to a portable terminal after a period of time since the portable terminal was last used by the user, the portable terminal will then operate in low power mode (low power drive and low brightness display) to reduce power consumption. However, some information (such as time, date, etc.) may continue to be displayed even when the portable terminal is operated in low power mode. In some instances, problems such as afterimages or lower life expectancy of the organic light emitting diodes may occur.

SUMMARY

The present disclosure addresses at least the above issues in the prior art.

According to an embodiment of the inventive concept, a display device is provided. The display device includes: a display panel comprising a plurality of pixels; a power supply configured to supply a first power voltage and a second power voltage to the display panel; and a driving circuit configured to determine, based on a viewing angle information signal, whether to operate the display device in a general mode or a low power mode, wherein, if the display device is operated in the low power mode: the driving circuit is further configured to deactivate the power supply, and supply a first subsidiary power voltage and a second subsidiary power voltage to the display panel.

In some embodiments, the display device may further include a viewing angle sensor configured to detect an inclination angle of the display device, and output the viewing angle information signal indicating whether a user's viewing angle lies within a main viewing angle range, wherein the user's viewing angle may be associated with the inclination angle of the display device.

In some embodiments, the viewing angle sensor may include a gyroscope sensor circuit.

In some embodiments, the first subsidiary power voltage may be lower than the first power voltage, and the second subsidiary power voltage may be higher than the second power voltage.

In some embodiments, the driving circuit may be further configured to output a control signal to control a size of a display area of the display panel, such that the size of a first display area when the display device is operated in the low power mode is less than the size of a second display area when the display device is operated in the general mode.

In some embodiments, the driving circuit may be further configured to control the display panel to emit light in n number of colors when the display device is operated in the low power mode, and wherein n may range from one to eight.

According to another embodiment of the inventive concept, a display device is provided. The display device includes: a display panel comprising a plurality of pixels; a power supply configured to supply a first power voltage and a second power voltage to the display panel; a viewing angle sensor configured to detect an inclination angle of the display device, and output a viewing angle information signal indicating whether a user's viewing angle lies within a main viewing angle range. The user's viewing angle is associated with the inclination angle of the display device. The display device further includes a driving circuit configured to determine, based on the viewing angle information signal, whether to operate the display device in a general mode or one of a plurality of low power modes. If the display device is operated in one of the plurality of low power modes, the driving circuit is further configured to deactivate the power supply, and supply a first subsidiary power voltage and a second subsidiary power voltage to the display panel.

In some embodiments, the viewing angle sensor may include a gyroscope sensor circuit.

In some embodiments, the first subsidiary power voltage may be lower than the first power voltage, and the second subsidiary power voltage may be higher than the second power voltage.

In some embodiments, each of the first subsidiary power voltage and the second subsidiary power voltage may change as a difference between the user's viewing angle and the main viewing angle range increases.

In some embodiments, the first subsidiary power voltage may decrease and the second subsidiary power voltage may increase as the difference between the user's viewing angle and the main viewing angle range increases.

In some embodiments, the driving circuit may be further configured to output a control signal to control a size of a display area of the display panel, such that the size of a first display area when the display device is operated in one of the plurality of low power modes is less than the size of a second display area when the display device is operated in the general mode.

In some embodiments, the size of the display area of the display panel may decrease as a difference between the user's viewing angle and the main viewing angle range increases.

In some embodiments, the display panel may be configured to emit light in n number of colors when the display device is operated in one of the plurality of low power modes, and wherein n may range from one to eight.

According to a further embodiment of the inventive concept, a display device is provided. The display device includes: a display panel comprising a plurality of pixels; a power supply configured to supply a first power voltage and a second power voltage to the display panel; a viewing angle sensor configured to detect a predetermined optimal inclination range and a change in inclination angle of the display device, and output a viewing angle information signal indicating whether a user's viewing angle lies within a main viewing angle range. The user's viewing angle is associated with the predetermined optimal inclination range and the change in inclination angle of the display device. The display device further includes a driving circuit configured to determine, based on the viewing angle information signal, whether to operate the display device in a general mode or one of a plurality of low power modes. If the display device is operated in one of the plurality of low power modes, the driving circuit is further configured to deactivate the power supply, and supply a first subsidiary power voltage and a second subsidiary power voltage to the display panel, and the second subsidiary power voltage increases as a difference between the user's viewing angle and the main viewing angle range increases.

In some embodiments, the viewing angle sensor may include a gyroscope sensor circuit.

In some embodiments, the first subsidiary power voltage may be lower than the first power voltage, and the second subsidiary power voltage may be higher than the second power voltage.

In some embodiments, the first subsidiary power voltage may decrease as the difference between the user's viewing angle and the main viewing angle range increases.

In some embodiments, the driving circuit may be further configured to output a control signal to control a size of a display area of the display panel, such that the size of a first display area when the display device is operated in one of the plurality of low power modes is less than the size of a second display area when the display device is operated in the general mode.

In some embodiments, the size of the display area of the display panel may decrease as the difference between the user's viewing angle and the main viewing angle range increases.

DETAILED DESCRIPTION

Figure 1:
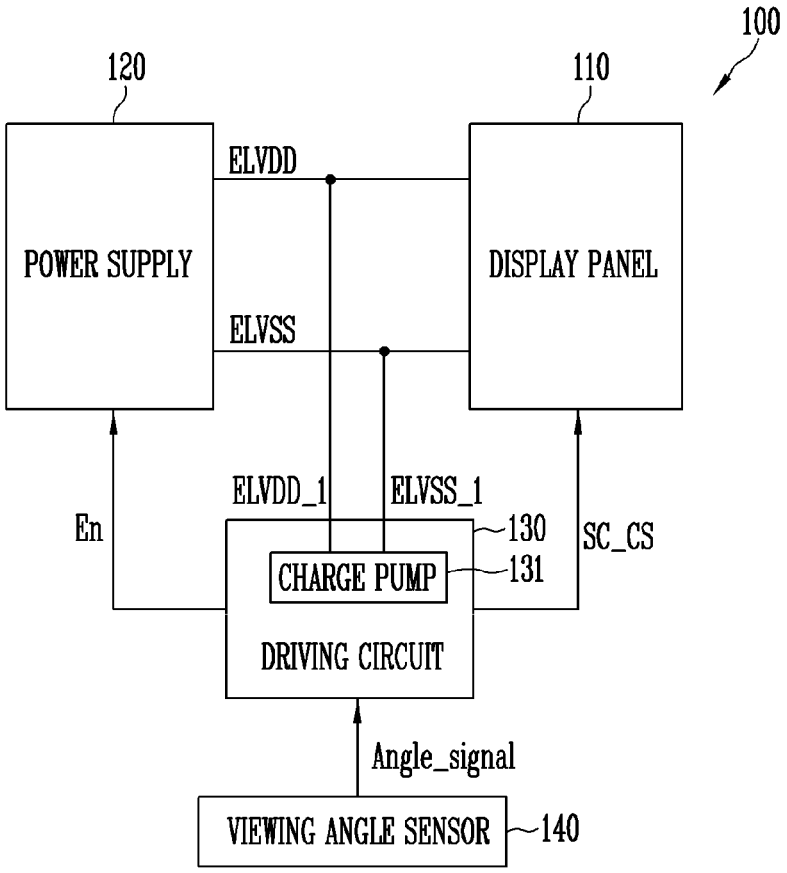
FIG. 1 is a block diagram of a display device according to an embodiment.

Exemplary embodiments are next described in detail with reference to the accompanying drawings. It is noted that the inventive concept may be embodied in different forms and should not be construed as being limited to the embodiments set forth herein. Rather, these embodiments are provided so as to convey the scope of the inventive concept to those skilled in the art.

In the drawings, lengths and sizes of regions may be exaggerated for clarity. Like reference numerals in the drawings denote like elements throughout.

Terms such as 'first' and 'second' may be used to describe various components, but should not be construed in a limiting manner. Rather, those terms are merely used to distinguish one component from another. For example, a first component may be interchangeably referred to as a second component, and a second component may be interchangeably referred to as a first component, and so forth, without departing from the spirit and scope of the present disclosure. Furthermore, the use of 'and/or' may include any one of or a combination of the components mentioned.

A singular form may include a plural form as long unless specified otherwise. Also, the terms "include/comprise" or "including/comprising" as used in the specification are not limiting, and may further include other components, steps, operations, and/or elements.

Furthermore, unless defined otherwise, all terms as used in this specification including technical and scientific terms have the same meanings as generally understood by those skilled in the related art. The terms defined in generally used dictionaries should be construed as having the same meanings as construed in the context of the related art, and unless clearly defined otherwise in this specification, should not be construed as having idealistic or overly formal meanings.

It is also noted that in this specification, the terms "connected/coupled" may refer to one component being directly connected/coupled to another component, or with one or more intervening components therebetween. In contrast, the terms "directly connected/directly coupled" refer to one component directly connected/coupled to another component without any intervening component. It will be understood that when an element is referred to as being disposed "between" two elements, it may be the only element disposed between the two elements, or with one or more intervening elements being present.

FIG. 1 is a block diagram of a display device according to an embodiment.

Referring to FIG. 1, a display device 100 includes a display panel 110, a power supply 120, a driving circuit 130, and a viewing angle sensor 140.

Although not illustrated in the drawings, the display panel 110 may include pixels. In some embodiments, the display panel 110 may include pixels comprising of organic light emitting diodes (OLEDs). The pixels may be configured to emit light of different brightness based on an input data signal received from an external source (not shown).

The display device 100 may operate in a general mode or a low power mode.

When the display device 100 is operated in the general mode, the display panel 110 is configured to receive a first power voltage (ELVDD) and a second power voltage (ELVSS) from the power supply 120. Specifically, a light-emitting portion (display area) of the display panel 110 is configured to emit light of different brightness based on the input data signal received from the external source.

The display device 100 operates in the low power mode when the display device 100 determines that a user's viewing angle lies outside of a main viewing angle range. When the display device 100 is operated in the low power mode, the display panel 110 is configured to receive a first subsidiary power voltage (ELVDD_1) and a second subsidiary power voltage (ELVSS_1) from the driving circuit 130, which subsequently reduces the brightness of the pixels. Furthermore, a control signal (SC_CS) may be sent from the driving circuit 130 to the display panel 110 to reduce an area of the light-emitting portion of the display panel 110. In some embodiments, the control signal (SC_CS) may further control the pixels to emit light in only one color (e.g. green) or up to eight colors, instead of the full color spectrum defined by the input data signal. It is noted that power consumption can be reduced by reducing the brightness of the pixels and the area of the light-emitting portion, and by emitting light in only one or limited number of colors.

When the display device 100 is operated in the general mode, the power supply 120 is activated in response to an enable signal (En) received from the driving circuit 130, and outputs the first power voltage (ELVDD) and the second power voltage (ELVSS) to the display panel 110. The power supply 120 may include a DC-DC converter circuit (not shown). Conversely, when the display device 100 is operated in the low power mode, the power supply 120 is deactivated so as to stop the output of the first power voltage (ELVDD) and the second power voltage (ELVSS) to the display panel 110.

As shown in FIG. 1, the driving circuit 130 may further include a charge pump 131 to output the first subsidiary power voltage (ELVDD_1) and the second subsidiary power voltage (ELVSS_1). The driving circuit 130 is configured to determine whether to operate the display device 100 in the general mode or the low power mode, based on a viewing angle information signal (Angle_signal) that is sent from the viewing angle sensor 140 to the driving circuit 130.

When the display device 100 is operated in the general mode, the driving circuit 130 outputs the enable signal (En) to activate the power supply 120. Conversely, when the display device 100 is operated in the low power mode, the driving circuit 130 activates the charge pump 131 to output the first subsidiary power voltage (ELVDD_1) and the second subsidiary power voltage (ELVSS_1). In some embodiments, the first subsidiary power voltage (ELVDD_1) that is output from the charge pump 131 may have a lower potential than the first power voltage (ELVDD) generated by the power supply 120, and the second subsidiary power voltage (ELVSS_1) that is output from the charge pump 131 may have a higher potential than the second power voltage (ELVSS) generated by the power supply 120.

Furthermore, when the display device 100 is operated in the low power mode, the driving circuit 130 outputs the control signal (SC_CS) to the display panel 110 to control a size of a display area of the display panel 110 (specifically, the area of the light-emitting portion in the display panel 110), such that the size of the display area when the display device 100 is operated in the low power mode is smaller than the size of the display area when the display device 100 is operated in the general mode.

The viewing angle sensor 140 is configured to determine whether the user's viewing angle lies within or outside of the main viewing angle range, and to output the viewing angle information signal (Angle_signal) to the driving circuit 130.

In some embodiments, the viewing angle sensor 140 may include a gyroscope sensor circuit. In those embodiments, the viewing angle sensor 140 is configured to predetermine an optimal inclination range of the display device 100 that is perpendicular to the main viewing angle range, measure the inclination angle of the display device 100, determine whether the user's viewing angle lies within or outside of the main viewing angle range, and output the viewing angle information signal (Angle_signal).

Figure 2:
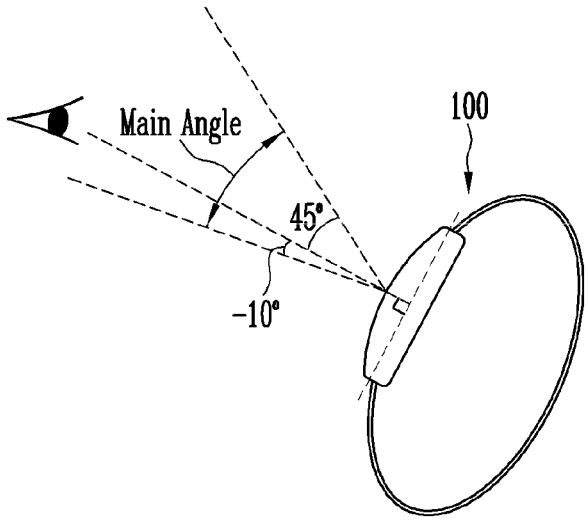
FIG. 2 illustrates a main viewing angle range of a display device according to an embodiment.

FIG. 2 illustrates a main viewing angle range of a display device according to an embodiment.

Referring to FIG. 2, the main viewing angle range may vary from −10° to 45° relative to the user's viewing angle (imaginary line-of-sight) perpendicular to the display device 100. However, the main viewing angle range is not limited to the aforementioned range of values. In another embodiment, the main viewing angle range may vary from −45° to 10° relative to the user's viewing angle (imaginary line-of-sight) perpendicular to the display device 100. In particular, the main viewing angle range may be set to a range that allows the user to easily recognize information displayed on the display panel 110 of the display device 100.

Figure 3:
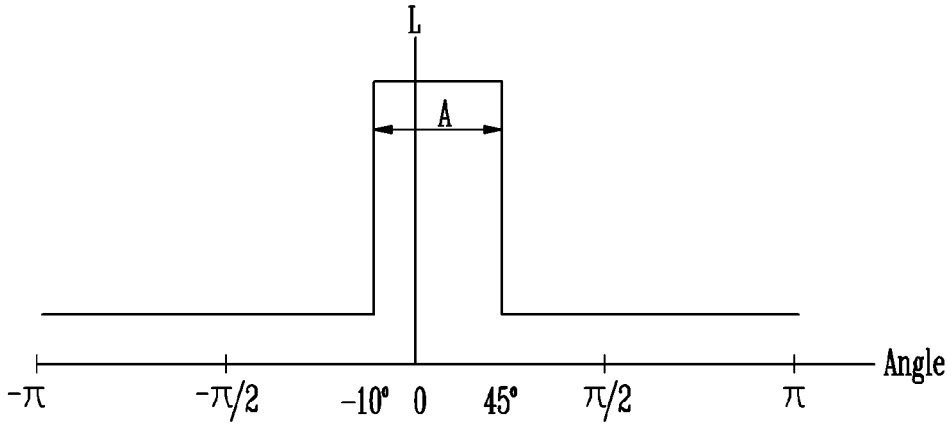
FIG. 3 is a graph of pixel brightness relative to a user's viewing angle during operation of a display device according to an embodiment.
Figure 4:
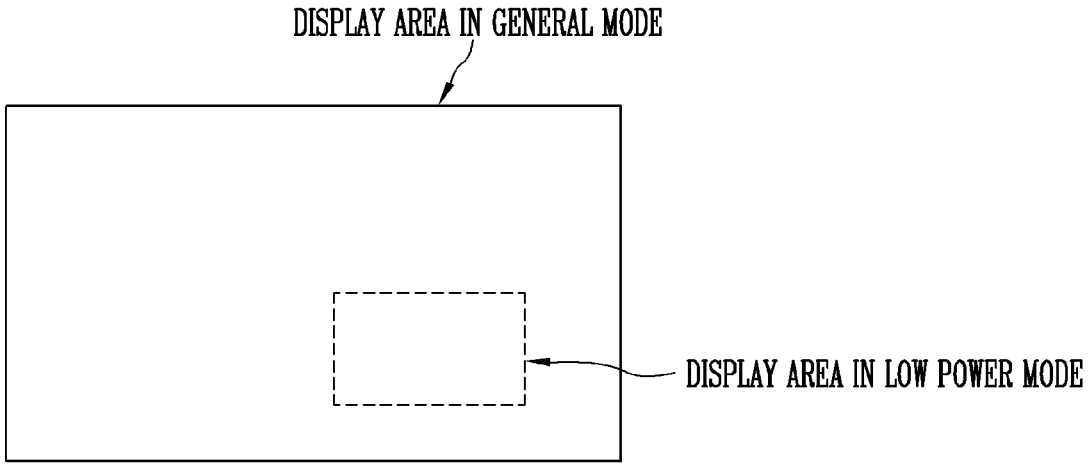
FIG. 4 illustrates a first light-emitting display area when an exemplary display device is operated in a general mode, and a second light-emitting display area when the exemplary display device is operated in a low power mode.

FIG. 3 is a graph of pixel brightness L relative to a user's viewing angle during operation of a display device according to an embodiment. FIG. 4 illustrates a first light-emitting display area when an exemplary display device is operated in the general mode, and a second light-emitting display area when the exemplary display device is operated in the low power mode.

The operation of the display device according to an embodiment is next described with reference to FIGS. 1, 3, and 4.

The viewing angle sensor 140 determines whether the user's viewing angle lies within or outside of the main viewing angle range, and outputs the viewing angle information signal (Angle_signal). Referring to FIGS. 2 and 3, the main viewing angle range (Main Angle) is set to A.

The driving circuit 130 determines whether to operate the display device 100 in the general mode or the low power mode based on the viewing angle information signal (Angle_signal), and then outputs the enable signal (En) and the control signal (SC_CS).

For example, when the display device 100 is operated in the general mode, the driving circuit 130 outputs the enable signal (En) to activate the power supply 120 to output the first power voltage (ELVDD) and the second power voltage (ELVSS). The display panel 110 receives the first power voltage (ELVDD) and the second power voltage (ELVSS), so as to power the pixels to emit light of different brightness based on an input data signal received from an external source.

Conversely, when the display device 100 is operated in the low power mode, the driving circuit 130 controls the enable signal (En) to deactivate the power supply 120, and outputs the first subsidiary power voltage (ELVDD_1) and the second subsidiary power voltage (ELVSS_1) using the charge pump 131. The display panel 110 receives the first subsidiary power voltage (ELVDD_1) and the second subsidiary power voltage (ELVSS_1) output from the charge pump 131. In some embodiments, the first subsidiary power voltage (ELVDD_1) output from the charge pump 131 may be lower than the first power voltage (ELVDD) output from the power supply 120, and the second subsidiary power voltage (ELVSS_1) output from the charge pump 131 may be higher than the second power voltage (ELVSS) output from the power supply 120, thereby reducing the brightness of the light-emitting pixels in the display panel 110. Furthermore, as illustrated in FIGS. 1 and 4, the driving circuit 130 outputs the control signal (SC-CS) to control a size of a display area of the display panel 100 (specifically, the area of the light-emitting portion in the display panel 110), such that the size of the display area when the display device 100 is operated in the low power mode is smaller than the size of the display area when the display device 100 is operated in the general mode. The control signal (SC-CS) is based on the viewing angle information signal (Angle_signal). In some embodiments, the control signal (SC_CS) may further control the pixels to emit light in only one color (e.g. green) or up to eight colors, instead of the full color spectrum as defined by the input data signal. It is noted that power consumption can be reduced by reducing the brightness of the pixels and the area of the light-emitting portion, and by emitting light in only one color or limited number of colors.

Figure 5:
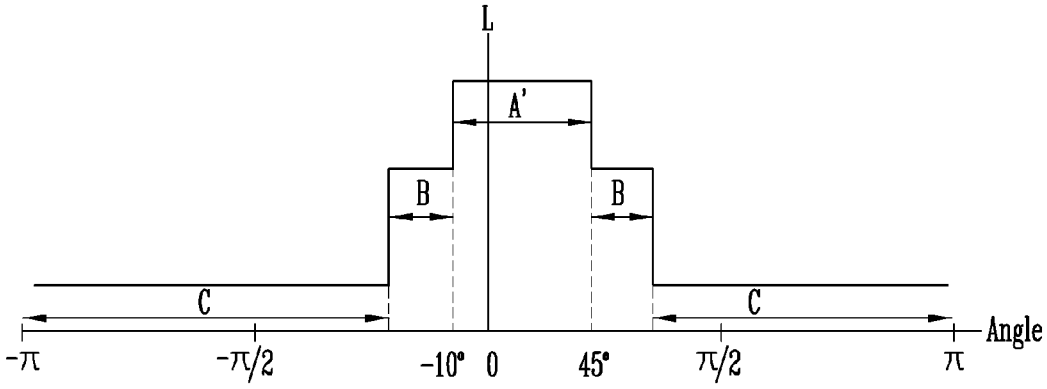
FIG. 5 is a graph of pixel brightness relative to a user's viewing angle during operation of a display device according to another embodiment.

FIG. 5 is a graph of pixel brightness L relative to a user's viewing angle during operation of a display device according to another embodiment.

Referring FIGS. 1 and 5, the viewing angle sensor 140 determines whether the user's viewing angle lies within a first main viewing angle range (A'), or within a second main viewing angle range (B), or outside of the first main viewing angle range and the second main viewing angle range (C), and outputs a viewing angle information signal (Angle_signal). In some embodiments, there may be two main viewing angle ranges comprising the first and second main viewing angle ranges. However, the inventive concept is not limited thereto. In some embodiments, there may be more than two main viewing angle ranges.

The driving circuit 130 determines whether to operate the display device 100 in the general mode, a first low power mode, or a second low power mode based on the viewing angle information signal (Angle_signal). For example, the display device 100 is operated in the general mode when the user's viewing angle lies within the first main viewing angle range (A'), in the first low power mode when the user's viewing angle lies within the second main viewing angle range (B), and in the second low power mode when the user's viewing angle lies outside the first main viewing angle range (A') and the second viewing angle range (B) (i.e., when the user's viewing angle lies in the range (C)).

When the display device 100 is operated in the general mode, the driving circuit 130 outputs the enable signal (En) to activate the power supply 120 to output the first power voltage (ELVDD) and the second power voltage (ELVSS). The display panel 110 receives the first power voltage (ELVDD) and the second power voltage (ELVSS), thereby enabling pixels to emit light of different brightness based on an input data signal received from an external source, so as to perform a display operation.

When the display device 100 is operated in the first low power mode, the driving circuit 130 controls the enable signal (En) to deactivate the power supply 120, and outputs the first subsidiary power voltage (ELVDD_1) and the second subsidiary power voltage (ELVSS_1) using the charge pump 131, thereby reducing the brightness of the display panel 110. In some embodiments, the first subsidiary power voltage (ELVDD_1) output from the charge pump 131 may be lower than the first power voltage (ELVDD) output from the power supply 120, and the second subsidiary power voltage (ELVSS_1) output from the charge pump 131 may be higher than the second power voltage (ELVSS) output from the power supply 120.

When the display device 100 is operated in the second low power mode, the driving circuit 130 controls the enable signal (En) to deactivate the power supply 120, and outputs the first subsidiary power voltage (ELVDD_1) and the second subsidiary power voltage (ELVSS_1) using the charge pump 131, so as to further reduce the brightness of the display panel 110 below that of the first low power mode. In some embodiments, the first subsidiary power voltage (ELVDD_1) output from the charge pump 131 when the display device 100 is operated in the second low power mode may be lower than the first subsidiary power voltage (ELVDD_1) output from the charge pump 131 when the display device 100 is operated in the first low power mode, and the second subsidiary power voltage (ELVSS_1) output from the charge pump 131 when the display device 100 is operated in the second low power mode may be higher than the second subsidiary power voltage (ELVSS_1) output from the charge pump 131 when the display device 100 is operated in the first low power mode.

In some embodiments, when the display device 100 is operated in the first low power mode or the second low power mode, the driving circuit 130 may output the control signal (SC_CS) based on the viewing angle information signal (Angle_signal) to control a size of a display area of the display panel 110 (specifically, the area of the light-emitting portion in the display panel 110), such that the size of the display area when the display device 100 is operated in the first low power mode or the second low power mode is smaller than the size of the display area when the display device 100 is operated in the general mode, and that the size of the display area when the display device 100 is operated in the second low power mode is smaller than the size of the display area when the display device 100 is operated in the first low power mode. Accordingly, the driving circuit 130 may control the size of the display area such that the size of the display area decreases as a difference between the user's viewing angle and the main viewing angle range (A') increases (i.e., as the user's viewing angle moves further from the main viewing angle range (A')).

Figure 6:
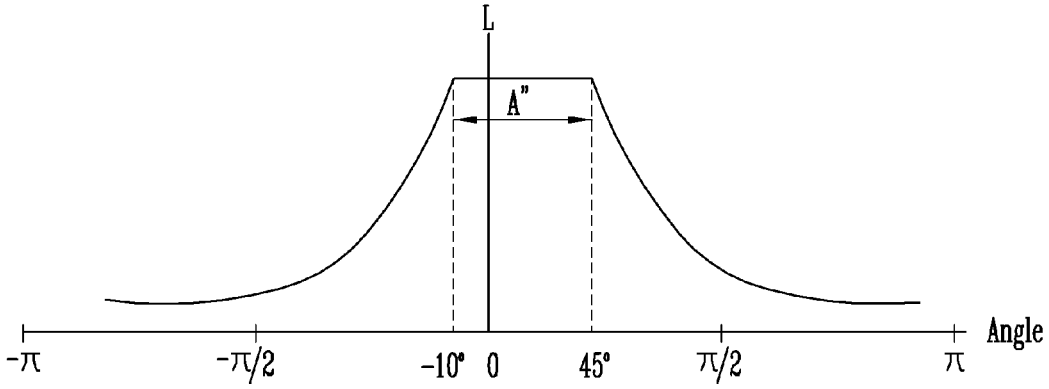
FIG. 6 is a graph of pixel brightness relative to a user's viewing angle during operation of a display device according to a further embodiment.

FIG. 6 is a graph of pixel brightness L relative to a user's viewing angle during operation of a display device according to a further embodiment.

Referring to FIGS. 1 and 6, the viewing angle sensor 140 determines whether the user's viewing angle lies within a main viewing angle range (A"). If the user's viewing angle does not lie within the main viewing angle range (A"), the viewing angle sensor 140 measures the user's viewing angle and outputs the viewing angle information signal (Angle_signal).

The driving circuit 130 determines whether to operate the display device 100 in the general mode or the low power mode based on the viewing angle information signal (Angle_signal). For example, when the user's viewing angle lies within the main viewing angle range (A"), the display device 100 is operated in the general mode. When the user's viewing angle lies outside the main viewing angle range (A"), the display device 100 is operated in the low power mode.

When the display device 100 is operated in the general mode, the driving circuit 130 outputs the enable signal (En) to activate the power supply 120 to output the first power voltage (ELVDD) and the second power voltage (ELVSS). The display panel 110 receives the first power voltage (ELVDD) and the second power voltage (ELVSS), thereby enabling pixels to emit light of different brightness based on an input data signal received from an external source, so as to perform a display operation.

When the display device 100 is operated in the low power mode, the driving circuit 130 controls the enable signal (En) to deactivate the power supply 120, and outputs the first subsidiary power voltage (ELVDD_1) and the second subsidiary power voltage (ELVSS_1) using the charge pump 131, thereby reducing the brightness of the display panel 110. The brightness may be controlled such that the brightness gradually decreases as a difference between the user's viewing angle and the main viewing angle range (A") increases (i.e., as the user's viewing angle moves further from the main viewing angle range (A")). For example, as the difference between the user's viewing angle and the main viewing angle range (A") increases, the first subsidiary power voltage (ELVDD_1) that is output from the charge pump 131 would decrease, and the second subsidiary power voltage (ELVSS_1) that is output from the charge pump 131 would increase.

Furthermore, when the display device 100 is operated in the low power mode, the driving circuit 130 may output the control signal (SC_CS) based on the viewing angle information signal (Angle_signal) to control a size of the display area in the display panel 110 (specifically, the area of the light-emitting portion in the display panel 110), such that the size of the display area when the display device 100 is operated in the low power mode is smaller than the size of the display area when the display device 100 is operated in the general mode, whereby the size of the display area decreases as a difference between the user's viewing angle and the main viewing angle range (A") increases (i.e., as the user's viewing angle moves further from the main viewing angle range (A")).

In the display device 100 according to the above-described embodiments, the brightness of the light-emitting pixels can be adjusted based on whether the user's viewing angle lies within the main viewing angle range. Also, the size of the display area (light-emitting portion) and the range of colors of light being emitted can be reduced, thereby further reducing power consumption.

Exemplary embodiments have been disclosed herein. Although specific terms may be employed, they are to be interpreted in a generic and descriptive sense and should not be construed in a limiting manner. One of ordinary skill in the art would appreciate that features, characteristics, and/or elements described in connection with a particular embodiment may be used alone or in combination with features, characteristics, and/or elements described in connection with other embodiments unless specified otherwise. Accordingly, it will be understood by those skilled in the art that various changes may be made to the described embodiments without departing from the spirit and scope of the present disclosure.

What is claimed is:

1. A display device comprising:

a display panel comprising a plurality of pixels;

a power supply configured to supply a first power voltage and a second power voltage to the display panel; and a driving circuit configured to determine, based on a viewing angle information signal, whether to operate the display device in a general mode or a low power mode, wherein, if the display device is operated in the low power mode:

the driving circuit is further configured to deactivate the power supply, and supply a first subsidiary power voltage and a second subsidiary power voltage to the display panel, and wherein the driving circuit is further configured to output a control signal to control a size of a display area of the display panel, such that the size of a first display area when the display device is operated in the low power mode is less than the size of a second display area when the display device is operated in the general mode.

2. The display device according to claim 1, further comprising:

a viewing angle sensor configured to detect an inclination angle of the display device, and output the viewing angle information signal indicating whether a user's viewing angle lies within a main viewing angle range, wherein the user's viewing angle is associated with the inclination angle of the display device.

3. The display device according to claim 2, wherein the viewing angle sensor comprises a gyroscope sensor circuit.

4. The display device according to claim 1, wherein the first subsidiary power voltage is lower than the first power voltage, and the second subsidiary power voltage is higher than the second power voltage.

5. The display device according to claim 1, wherein the driving circuit is further configured to control the display panel to emit light in n number of colors when the display device is operated in the low power mode, and wherein n ranges from one to eight.

6. A display device comprising:

a display panel comprising a plurality of pixels;

a power supply configured to supply a first power voltage and a second power voltage to the display panel;

a viewing angle sensor configured to detect an inclination angle of the display device, and output a viewing angle information signal indicating whether a user's viewing angle lies within a main viewing angle range, wherein the user's viewing angle is associated with the inclination angle of the display device; and a driving circuit configured to determine, based on the viewing angle information signal, whether to operate the display device in a general mode or one of a plurality of low power modes, wherein, if the display device is operated in one of the plurality of low power modes:

the driving circuit is further configured to deactivate the power supply, and supply a first subsidiary power voltage and a second subsidiary power voltage to the display panel, and wherein each of the first subsidiary power voltage and the second subsidiary power voltage changes as a difference between the user's viewing angle and the main viewing angle range increases.

7. The display device according to claim 6, wherein the viewing angle sensor comprises a gyroscope sensor circuit.

8. The display device according to claim 6, wherein the first subsidiary power voltage is lower than the first power voltage, and the second subsidiary power voltage is higher than the second power voltage.

9. The display device according to claim 6, wherein the first subsidiary power voltage decreases and the second subsidiary power voltage increases as the difference between the user's viewing angle and the main viewing angle range increases.

10. The display device according to claim 6, wherein the driving circuit is further configured to output a control signal to control a size of a display area of the display panel, such that the size of a first display area when the display device is operated in one of the plurality of low power modes is less than a size of a second display area when the display device is operated in the general mode.

11. The display device according to claim 6, wherein the size of the display area of the display panel decreases as the difference between the user's viewing angle and the main viewing angle range increases.

12. The display device according to claim 11, wherein the display panel is configured to emit light in n number of colors when the display device is operated in one of the plurality of low power modes, and wherein n ranges from one to eight.

13. A display device comprising:

a display panel comprising a plurality of pixels;

a power supply configured to supply a first power voltage and a second power voltage to the display panel;

a viewing angle sensor configured to detect a predetermined optimal inclination range and a change in inclination angle of the display device, and output a viewing angle information signal indicating whether a user's viewing angle lies within a main viewing angle range, wherein the user's viewing angle is associated with the predetermined optimal inclination range and the change in inclination angle of the display device; and a driving circuit configured to determine, based on the viewing angle information signal, whether to operate the display device in a general mode or one of a plurality of low power modes, wherein, if the display device is operated in one of the plurality of low power modes:

the driving circuit is further configured to deactivate the power supply, and supply a first subsidiary power voltage and a second subsidiary power voltage to the display panel, and wherein the second subsidiary power voltage increases as a difference between the user's viewing angle and the main viewing angle range increases.

14. The display device according to claim 13, wherein the viewing angle sensor comprises a gy roscope sensor circuit.

15. The display device according to claim 13, wherein the first subsidiary power voltage is lower than the first power voltage, and the second subsidiary power voltage is higher than the second power voltage.

16. The display device according to claim 13, wherein the first subsidiary power voltage decreases as the difference between the user's viewing angle and the main viewing angle range increases.

17. The display device according to claim 13, wherein the driving circuit is further configured to output a control signal to control a size of a display area of the display panel, such that the size of a first display area when the display device is operated in one of the plurality of low power modes is less than the size of a second display area when the display device is operated in the general mode.

18. The display device according to claim 13, wherein the size of the display area of the display panel decreases as the difference between the user's viewing angle and the main viewing angle range increases.

* * * * *